US010415198B1

(12) United States Patent
Thomas

(10) Patent No.: US 10,415,198 B1
(45) Date of Patent: Sep. 17, 2019

(54) MOBILE VEHICLE BARRIER

(71) Applicant: COWBOY BARRIERS LLC, Owasso, OK (US)

(72) Inventor: Dirk Scott Thomas, Owasso, OK (US)

( * ) Notice: Subject to any disclaimer, the term of this patent is extended or adjusted under 35 U.S.C. 154(b) by 80 days.

(21) Appl. No.: 15/880,171

(22) Filed: Jan. 25, 2018

Related U.S. Application Data

(60) Provisional application No. 62/451,187, filed on Jan. 27, 2017.

(51) Int. Cl.
*E01F 13/02* (2006.01)
*E01F 13/12* (2006.01)

(52) U.S. Cl.
CPC ..... *E01F 13/12* (2013.01); *E01F 13/02* (2013.01)

(58) Field of Classification Search
CPC ..... E01F 15/003; E01F 15/02; E01F 15/10; E01F 13/02
USPC ..... 404/6; 49/9, 33; 116/63 P
See application file for complete search history.

(56) References Cited

U.S. PATENT DOCUMENTS 56,441 A * 7/1866 Olds ..... E01F 13/02 256/64
101,351 A * 3/1870 Coffield ..... E01F 13/02 256/64
151,616 A * 6/1874 Owens ..... E01F 13/02 256/64
156,363 A * 10/1874 Mabie ..... E01F 13/02 256/64
158,941 A * 1/1875 Hogue ..... E01F 13/02 256/64
369,571 A * 9/1887 Van Cleave ..... E01F 13/02 256/64
370,299 A * 9/1887 Wilson ..... E01F 13/02 256/64
487,573 A * 12/1892 Jobe, Sr. ..... E01F 13/02 256/64
2,783,055 A 2/1957 Michaud
3,057,601 A * 10/1962 Simpson ..... E01F 13/02 256/59
3,630,491 A 12/1971 Puccio
3,968,596 A 7/1976 Danin
(Continued)

FOREIGN PATENT DOCUMENTS

GB 2178094 A * 2/1987 ..... E01F 13/12
WO 2016030886 3/2016

OTHER PUBLICATIONS

Security Solutions International; PVB—Portable Vehicle Barrier; 2017; 35 pages.

(Continued)

*Primary Examiner* — Thomas B Will
*Assistant Examiner* — Katherine J Chu
(74) *Attorney, Agent, or Firm* — McAfee & Taft

(57) ABSTRACT

A portable vehicle barrier for barricading restricted areas from vehicular access, the barrier having a base, and a first and second member. The first end of the first member and second member are detachably coupled to the base such that the first member extends horizontally from the base and the second member extends vertically from the base. An angle-brace coupler is coupled to the first member and second member. The first member and second member comprise a generally "L" shaped unit. The portable vehicle barrier can comprise a plurality of such "L" shaped units coupled together.

7 Claims, 7 Drawing Sheets

(56) References Cited

U.S. PATENT DOCUMENTS

| | | | | |
|---|---|---|---|---|
| 4,780,020 | A * | 10/1988 | Terio | E01F 13/048 404/6 |
| 4,968,177 | A * | 11/1990 | Bechtold | E01F 13/02 116/63 P |
| 5,345,731 | A * | 9/1994 | Sykes | A47D 13/043 256/1 |
| 5,549,410 | A * | 8/1996 | Beryozkin | E01F 13/12 404/6 |
| 5,704,730 | A * | 1/1998 | Burton-Chambers | E01F 13/123 404/6 |
| 6,279,276 | B1 * | 8/2001 | Knoll | B65G 69/2876 160/205 |
| 6,702,512 | B1 | 3/2004 | Reale | |
| 6,772,986 | B1 * | 8/2004 | Bennett | F16B 12/20 248/223.41 |
| 7,172,176 | B1 | 2/2007 | Eastland | |
| 7,258,505 | B2 | 8/2007 | Dehart | |
| 7,320,557 | B1 * | 1/2008 | Potter | E01F 13/123 404/6 |
| 7,384,211 | B2 * | 6/2008 | Wong | E01F 13/12 256/1 |
| 7,484,905 | B2 | 2/2009 | Gelfand et al. | |
| 7,845,877 | B2 | 12/2010 | Gelfand et al. | |
| 7,918,622 | B2 * | 4/2011 | Whitford | F41H 11/08 256/13.1 |
| 8,215,866 | B2 * | 7/2012 | Whitford | F41H 11/08 256/13.1 |
| 8,240,947 | B2 | 8/2012 | Gelfand et al. | |
| 8,439,594 | B1 * | 5/2013 | Clark | E01F 13/12 256/13.1 |
| 8,491,216 | B2 * | 7/2013 | Dyke | E01F 15/146 404/10 |
| 8,777,512 | B2 * | 7/2014 | Henderson | E01F 13/02 116/63 C |
| 8,794,866 | B2 | 8/2014 | Petryshyn | |
| 9,028,166 | B2 | 5/2015 | Morgan et al. | |
| 2006/0078380 | A1 * | 4/2006 | Dehart | E01F 13/12 404/6 |
| 2006/0266274 | A1 * | 11/2006 | Kuo | E01F 13/02 116/63 P |
| 2012/0177439 | A1 | 7/2012 | More et al. | |
| 2014/0010591 | A1 * | 1/2014 | Ball | E01F 13/12 404/6 |
| 2016/0115661 | A1 * | 4/2016 | Neusch | E01F 13/123 404/6 |
| 2017/0130410 | A1 * | 5/2017 | Holmer | E01F 13/12 |

OTHER PUBLICATIONS

I24NEWS; German authorities order Israeli anti-vehicle barriers in wake of Berlin attack article; David Ruhm; Dec. 23, 2016; 4 pages.

Written Opinion of the International Searching Authority in PCT/IL2015/050850; dated Dec. 23, 2015; 8 pages.

MIFRAM Ltd Security Division; The MVB—Modular Vehicle Barrier Photo; Oct. 2004; 1 page.

MIFRAM Security; MVB: Modular Vehicle Barrier (www.miframsecurity.com); 12 pages; Retrieved on Jan. 24, 2017.

Homeland Security Network; PVB: The PVB—Portable Vehicle Barrier (www.homelandsecuritynet.com/intelligence/products); 2015; 1 page.

Security Solutions International; PVB: Portable Vehicle Barrier (www.homelandsecurityssi.com/portable-vehicle-barrier); 2013; 1 page.

Security Solutions International; Portable Vehicle Barriers (PVB) (www.homelandsecurityssi.com/images/pvb-powerpoint.pdf); Retrieved on Mar. 21, 2017; 9 pages.

Homeland Security; Portable Vehicle Barrier Image (www.homelandsecuritynet.com/images/stories/pvb.jpg); Retrieved on Mar. 21, 2017; 1 page.

* cited by examiner

MOBILE VEHICLE BARRIER

CROSS-REFERENCE TO RELATED APPLICATIONS

This application claims the benefit of U.S. Provisional Application No. 62/451,187 filed Jan. 27, 2017, which is hereby incorporated by reference.

FIELD

The present disclosure relates generally to portable devices for barricading restricted areas from vehicular access.

BACKGROUND

Government and private entities use a variety of barriers to cordon off restricted areas. For example, police, security forces and private individuals often wish to control vehicle access to areas or to temporarily block off roads and open areas, including parking lots, yards and fields.

Traditionally, such barriers have included concrete barriers and spike strips. However, existing barriers often sacrifice effectiveness for ease of use or vice versa. For example, spike strips, while easy to deploy, merely puncture a vehicle's tires, after which it can still travel for some distance. Concrete barriers are much more effective in stopping vehicles but are also much more difficult to store, deploy and move.

Additionally, a variety of mobile barriers has been proposed which try to achieve the advantages of concrete barriers while still having the mobility associated spike strips. Unfortunately, these prior mobile barriers have not lived up to the desired function of a mobile barrier that is easy to assemble, deploy, and transport, while still being an effective barrier. Accordingly, there is a need for a portable vehicle barrier that is a user-friendly anti-ramming device, which is detachable and portable.

SUMMARY OF THE DESCRIPTION

This disclosure relates to a portable vehicle barrier. In one embodiment, the portable vehicle barrier comprises at least one generally "L" shaped unit. The generally "L" shaped unit has a base, a first member, a second member and an angle-brace coupler. The first member and the second member each have a first end and a second end. The first end of the first member is received in the base and detachably coupled to the base such that the first member extends horizontally from the base. The first end of the second member is received in the base and detachably coupled to the base such that the second member extends vertically from the base.

The angle-brace coupler is coupled to the first member and the second member. The angle-brace coupler is coupled at a first terminus to the first member at a position distal from the first end of the first member, and is coupled at a second terminus to the second member at a position distal from the first end of the second member.

Generally, the portable vehicle barrier comprises at least two generally "L" shaped units as described above. In such embodiments, the portable vehicle barrier can further comprise a first horizontal bracing connecting the first member of each of the generally "L" shaped units. More typically, the portable vehicle barrier also includes a second horizontal bracing connecting the second member of each of the generally "L" shaped units.

The first and second horizontal bracings can each be a flexible cable. Typically, the flexible cables have a plurality of loops for receiving a post mounted on the first or second member, as appropriate. Further, the first horizontal bracing can have a thimble positioned in each of its loops. The thimble has an orifice for receiving the post mounted on the first member.

In the above embodiments, the first member and the second member can be at an angle from about 75 degrees to about 125 degrees to each other, optionally they can be about perpendicular to each other.

Additionally, the first member and the second member each have a mid-point midway between the first end and the second end. The distal position where the angle-brace coupler is attached to the first member can be between the mid-point and the second end of the first member, and the distal position where the angle-brace coupler is attached to the second member can be between the mid-point and the second end of the second member.

In any of the above embodiments, the angle-brace coupler can be flexible so as to resiliently bend towards the base when impacted.

The base can have a side profile comprising a first edge, a second edge and a third edge. The first edge and the second edge can meet at an apex. The third edge can extend from the first edge to the second edge. The third edge can have an arcuate shape so as to form a downward extending point with the second edge. The point is positioned distal from the detachable coupling of the first member and distal from the detachable coupling of the second member.

In any of the above embodiments, the first member can have a pointed foot at an angle from the first end. The first member can be pivotally coupled to the base such that upon impact the second end of the first member pivots upwards and the pointed foot pivots downward to dig into a surface.

This disclosure also relates to a method of deploying a portable vehicle barrier, which can be in accordance with any of the above embodiments. The method comprises assembling a plurality of "L" shaped units by the steps of:

- attaching a first member to a base by a pin to create a first pivotal connection where pivotal movement is limited by the base;
- attaching a second member to the base by a pin to create a pivotal connection where pivotal movement is limited by the base; and
- linking the first member to the second member by an angle-brace coupler, wherein the angle-brace coupler is attached to the first member at a first position on the first member, the first position being distal from the attachment of the first member to the base, and the angle-brace coupler is attached to the second member at a second position on the second position, the second position being distal from the attachment of the second member to the base, and wherein the base, the first member, second member and the angle-brace coupler form the "L" shaped unit.

Additionally, the method comprises the steps of:

- lining up the "L" shaped units up into a row such that each "L" shaped unit has a neighboring "L" shaped unit;
- connecting each "L" shaped unit to the neighboring "L" shaped unit by coupling a first horizontal bracing to the first member of the "L" shaped unit and to the first member of the neighboring "L" shaped unit; and connecting each "L" shaped unit to the neighboring "L" shaped unit by coupling a second horizontal bracing to the second member of the "L" shaped unit and to the second member of the neighboring "L" shaped unit.

BRIEF DESCRIPTION OF THE DRAWINGS

The foregoing summary as well as the following detailed description of the preferred embodiments of the present invention will be better understood when reviewed in conjunction with the appended drawings. It should be understood that the invention is not limited to the precise arrangements and instrumentalities shown. Further, the components in the drawings are not necessarily to scale, emphasis instead is placed upon clearly illustrating the principles of the present invention. Moreover, in the drawings, like reference numerals designate corresponding parts throughout the several views. In the drawings:

FIG. 6 is a perspective view of an "L" shaped unit useable in a portable vehicle barrier in accordance with one embodiment of this disclosure.

FIG. 8 is an exploded view of the "L" shaped unit illustrated in FIG. 1.

DETAILED DESCRIPTION

The present disclosure may be understood more readily by reference to the following detailed description and figures. In addition, numerous specific details are set forth in order to provide a thorough understanding of the embodiments described herein. However, those of ordinary skill in the art will understand that the embodiments described herein can be practiced without these specific details. In other instances, methods, procedures and components have not been described in detail so as not to obscure the related relevant feature being described.

Figure 1:
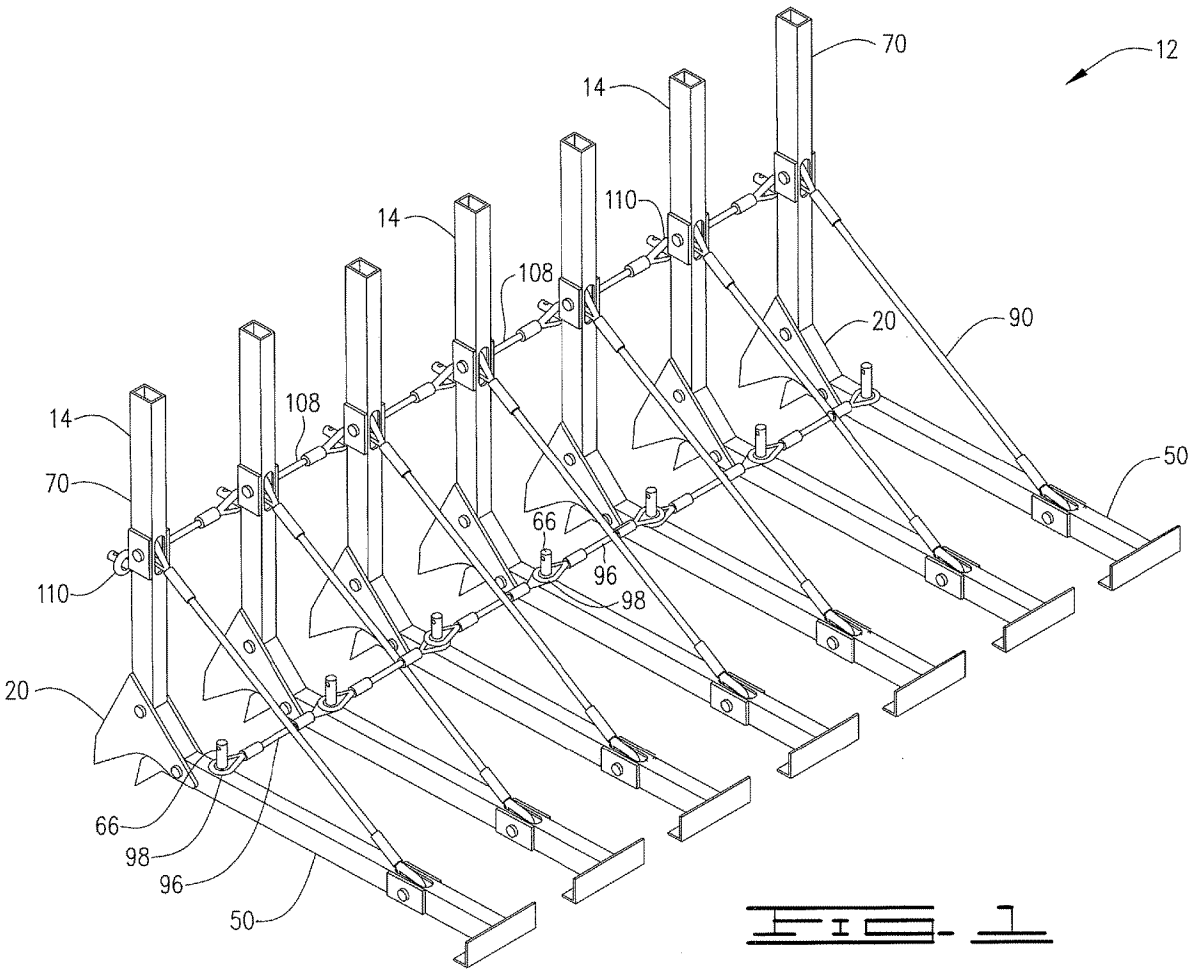
FIG. 1 is a perspective view of a portable vehicle barrier assembled for several "L" shaped units in accordance with an embodiment of this disclosure.

As can be seen from FIG. 1, the present barrier 12 comprises at least one generally "L" shaped unit 14, and more typically two or more "L" shaped units 14. For many uses, barrier 12 will comprise five or more "L" shaped units 14. Each "L" shaped unit 14 has a base 20, a first member 50 and a second member 70. As further described below, first member 50 and second member 70 are elongated members which are coupled to base 20 so as to form the generally "L" shape. As used herein, "generally 'L' shaped" and "'L' shaped" refer to the elongated members being configured with a 90-degree angle, but which may also include, depending on the application for which the barrier will be used, at the angles ranging from 75 degrees to 125 degrees. In other words, typically first member 50 and second member 70 will be coupled to base 20 so as to be perpendicular; however, for some applications a broader range of the angle of attachment will suffice but the angle will still be within the range of from 75 degrees to 125 degrees. "L" shaped units 14 are designed so that when they are hit by a vehicle, they act as a unit and individually to rock back and dig in using the vehicle's force against it, thus stopping the vehicle.

Figure 2:
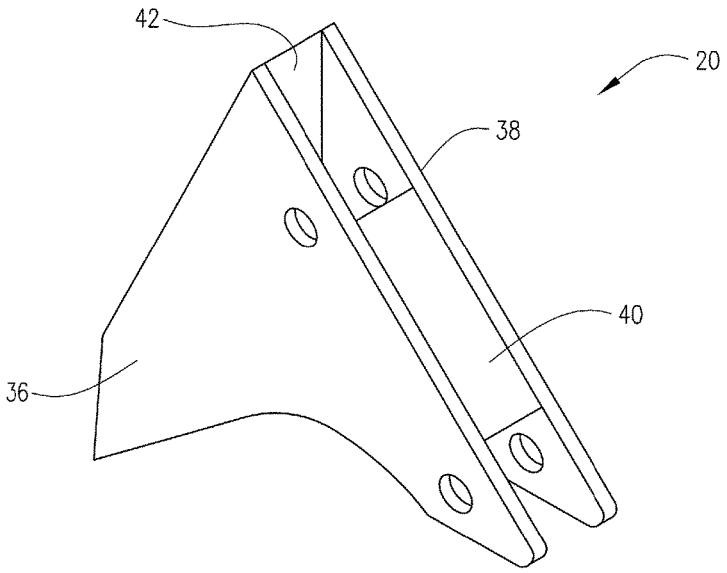
FIG. 2 is a perspective view of a base suitable for use in assembling an "L" shaped unit such as shown in FIG. 1.
Figure 3:
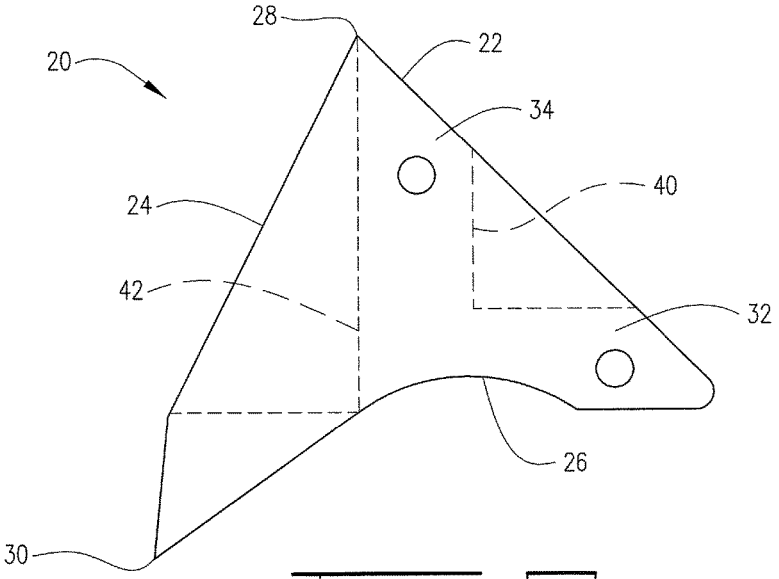
FIG. 3 is a side view of the base illustrated in FIG. 5.

Turning now to FIGS. 2-9, the components of "L" shaped unit 14 will be further described. First, as illustrated in FIGS. 2 and 3, base 20 has a shape that can accommodate coupling to first member 50 and second member 70, and holding them in a generally "L" shape. Preferably, base 20 is configured to dig into a surface (pavement or ground, not shown) upon impact. Base 20 can have any suitable shape, which accomplishes these requirements. For example, as illustrated in FIGS. 2 and 3, base 20 can have a generally triangular shape such that it has a side profile comprising a first edge 22, a second edge 24 and a third edge 26. First edge 22 and second edge 24 meet at an apex 28, which is the highest point of the base when the "L" shaped unit is assembled. Third edge 26 extends from first edge 22 to second edge 24. Third edge 26 has an arcuate shape so as to form a downward projecting point 30 with second edge 24. Point 30 is downward pointing and positioned distal from the pocket 32 for first member 50 and distal from the pocket 34 for second member 70. As will be realized from this disclosure as a whole, an impact coming towards first edge 22 can result in point 30 digging into the surface.

First side 36 and second side 38 of base 20 can be connected by plates 40 and 42, such that pockets 32 and 34 are formed for receiving first member 50 and second member 70, respectively. It will be appreciated that pocket 32 is generally left open adjacent to third edge 26 so as to allow pivoting of first member 50, as described below. Pocket 34 is enclosed on at least four sides to restrict pivoting of second member 70. However, pocket 34 can be slightly oversized compared to the parameter of second member 70 so as to enhance structural integrity of the "L" shaped unit 14 in an impact by allowing second member 70 to give or pivot slightly in an impact. Generally, base 20 can be constructed of metal, such as machined steel, and can be cast as a single unit or have its components welded together. For example, plates 40 and 42 can be welded to first side 36 and second side 38 or the plates and sides can be cast as a single unit.

Figure 4:
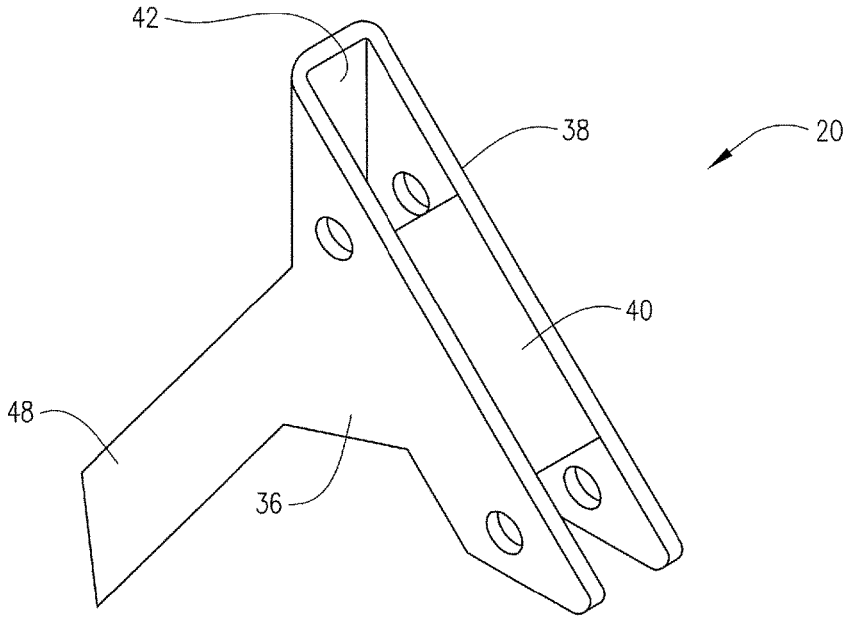
FIG. 4 is a perspective view of another base suitable for use in assembling an "L" shaped unit such as shown in FIG. 1.
Figure 5:
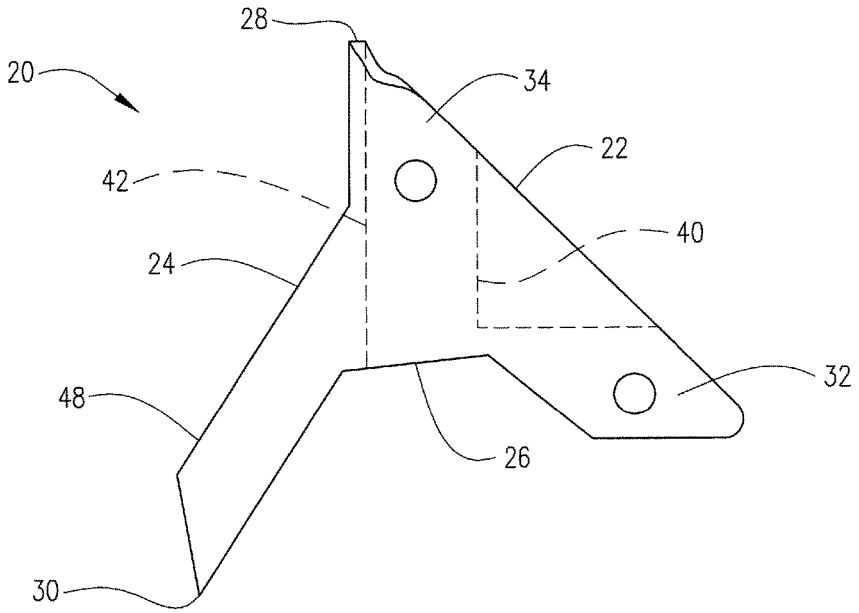
FIG. 5 is a side view of the base illustrated in FIG. 7.
Figure 5:
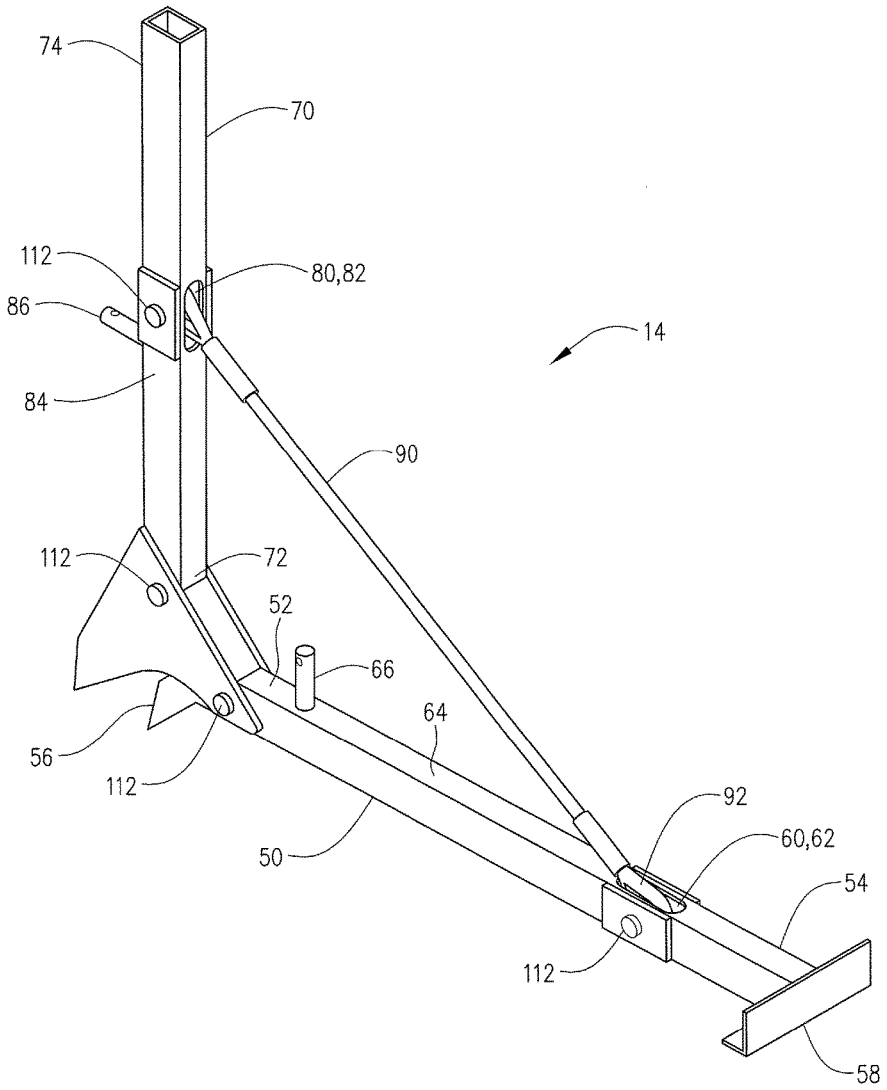

FIGS. 4 and 5 show an alternative embodiment of base 20, where second edge 24 and third edge 26 have an angular shape so as to form an outward and downward extending arm 48, which terminates in point 30.

Figure 7:
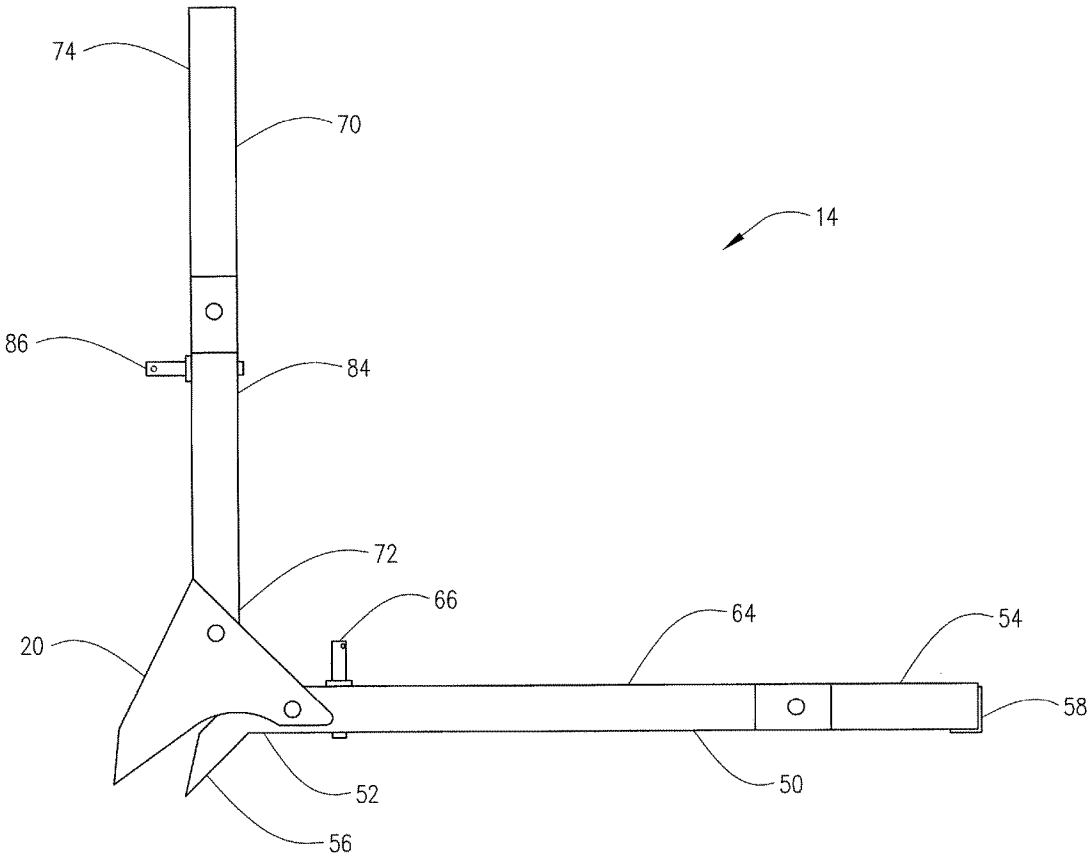
FIG. 7 is a side view of the "L" shaped unit illustrated in FIG. 1.
Figure 3:
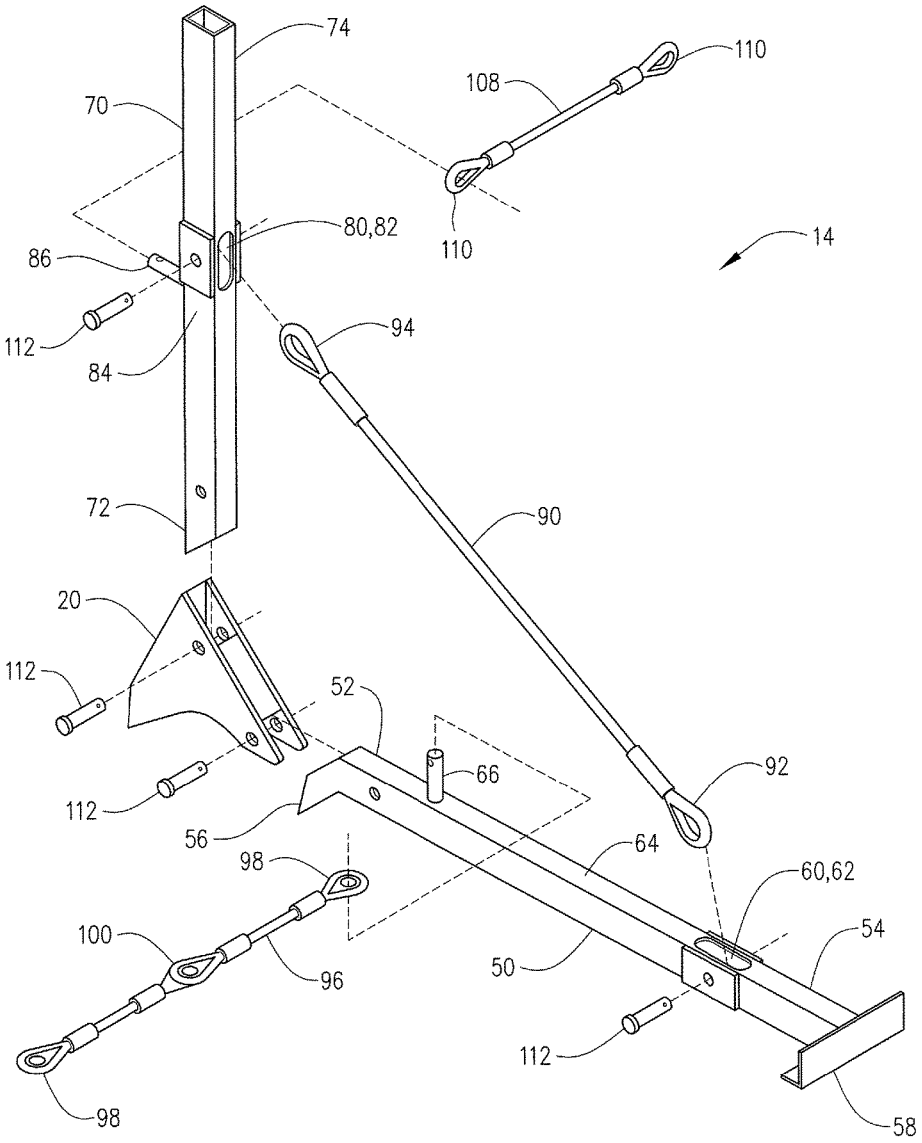

Turning now to FIGS. 6, 7 and 8, the other components of "L" shaped unit 14 and their connection will now be described. First member 50 has a first end 52 and a second end 54. As best seen from FIG. 8, first member 50 has an elongated shape with a square cross-section. Generally, first member 50 will be a hollow tube or beam and can be constructed of steel. At first end 52, first member 50 has a pointed foot 56, which extends downward so as to be able to dig into the surface (pavement or ground, not shown) upon impact. Additionally, second end 54 of first member 50 can terminate in a brace 58.

First end 52 is received in pocket 32 of base 20 and detachably coupled to base 20 such that first member 50 extends horizontally or laterally from base 20. The coupling is typically a pivoting coupling. This pivoting coupling, along with the open side of pocket 32 adjacent to third edge 26 of base 20, allows, upon impact, second end 54 of first member 50 to pivot upwards and pointed foot 56 to pivot downward and thus to dig into the surface. Pivoting in the opposite direction is limited or confined by plate 40.

First member 50 has a coupling element 60 to facilitate coupling to an angle-brace coupler 90 at a position distal from first end 42. For example, coupling element can be port 62, which allows insertion and pinning of a looped first terminus or end 92 of angle-brace coupler 90. In some embodiments, coupling element 60 is located between second end 54 and a mid-point 64, which is located midway between first end 52 and the second end 54.

Second member 70 has a first end 72 and a second end 74. As best seen from FIG. 8, second member 70 has an elongated shape with a square cross-section. Generally, second member 70 will be a hollow tube or beam and can be constructed of steel. First end 72 is received in pocket 34 of base 20 and detachably coupled to base 20 such that first member 70 extends upwards or vertically from base 20. The coupling is typically a pivoting coupling; although, the pivoting is confined or limited by pocket 34, that is by plates 40 and 42.

Second member 70 has a coupling element 80 to facilitate coupling to an angle-brace coupler 90 at a position distal from first end 72. For example, coupling element can be port 82, which allows insertion and pinning of a looped second terminus or end 94 of angle-brace coupler 90. In some embodiments, coupling element 80 is located between second end 74 and a mid-point 84, which is located midway between first end 72 and the second end 74.

As can best be seen from FIGS. 1, 6 and 8, angle-brace coupler 90 extends from first member 50 to second member 70 so as to form a triangle with the first and second members. Angle-brace coupler 90 can be flexible and is typically a flexible steel cable. Thus, angle-brace coupler 90 can resiliently bend towards base 20 and towards first member 50 and second member 70, when impacted.

Returning now to FIG. 1, "L" shaped units 14 can be linked together by horizontal bracing, which can be, for example, high tensile strength cables, such as steel cables. As illustrated, "L" shaped units 14 are linked by a first set of horizontal cables 96 and second set of horizontal cables 108. However, angle-brace coupler 90 prevents first member 50 and second member 70 from pivoting away from each other at impact; that is, angle-brace coupler 90 prevents the angle between first member 50 and second member 70 from increasing beyond the "L" shaped configuration or greater than 125 degrees, and more typically greater than about 100 degrees or greater than about 95 degrees.

Figure 9:
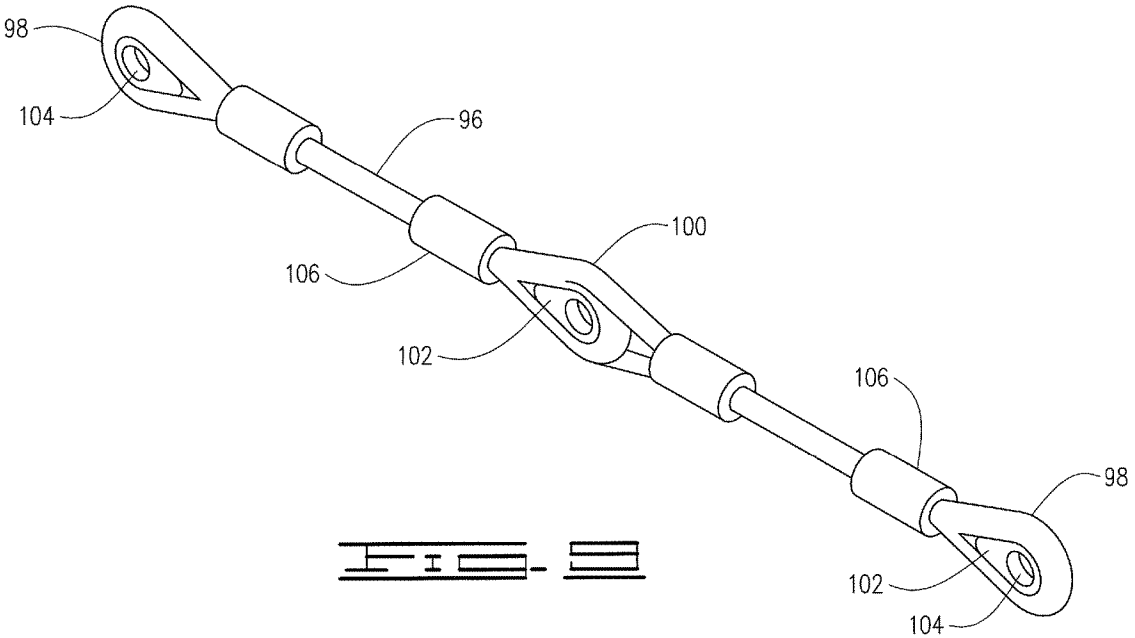
FIG. 9 is a perspective view of a cable with a thimble as can be used in the "L" shaped units of this disclosure.
Figure 10:
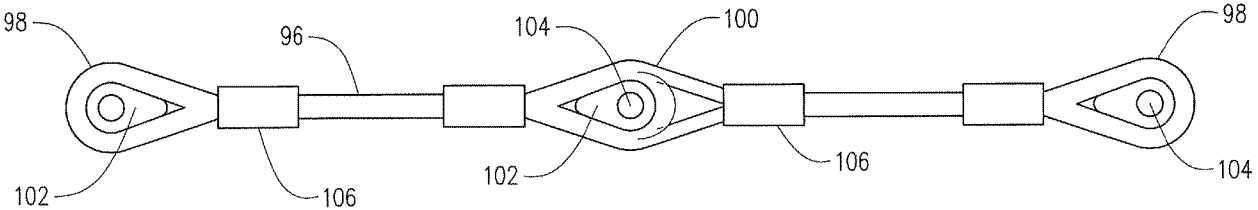
FIG. 10 is a side view of the cable of FIG. 9.

First set of horizontal cables 96 connects first members 50 of each of the generally "L" shaped units. For example, first set of horizontal cables 96 can be comprised of flexible cables (for example, flexible steel cables) with loops 98 at each end so that cables 96 can connect adjacent or neighboring "L" shaped units 14 by the loops being positioned on post 66 of first member 50. In some embodiments, cables 96 have one or more additional loops between the end loops 98 so as to be able to connect more than two neighboring "L" shaped units. For example, as illustrated in FIGS. 9 and 10, a cable 96 can have a loop 98 at each end and a loop 100 in-between loops 98. Thus, cable 96 illustrated in FIGS. 9 and 10 can connect three neighboring "L" shaped units together, with subsequent units being connected by overlapping cables on post 66 of one of the three thus connected "L" shaped units.

Additionally, cables 96 can include a thimble 102 positioned in each of its loops 98, 100. Thimble 102 has an orifice 104 for receiving post 66 thus mounting cable 96 first member 50. Generally, thimble 102 provides for a more secure attachment of cable 96 by having a more narrow orifice 104 than loop 98 or 100 and by providing additional weight to the loop area.

As second set of horizontal cables 108 can connect second members 70 of each of the generally "L" shaped units similarly to the connections described above for cables 96 and first members 50. For example, second set of horizontal cables 108 can be comprise of flexible cables (for example, flexible steel cables) with loops 110 at each end so that cables 108 can connect adjacent or neighboring "L" shaped units 14 by the loops being positioned on post 86 of second member 70. The loops of cables 96 and 108 can be formed by techniques known in the art such as by using compression sleeves 106.

Cables 96 and cables 108 keep the "L" shaped units from separating on impact. In some embodiments, cables 96, 108 can be held in place by a steel bar (not shown), which spans numerous "L" shaped units; however, the steel bar is generally not required. Additionally, use of a steel bar may restrict curving of the barrier 12, which is allowed by use of flexible cables and which can facilitate placement of barrier 12 as a single unit. In this manner, numerous "L" shaped units" may be linked together. There is an infinite number of "L" shaped units which may be linked together, depending on the width or parameter of the property which is in need of protection.

The couplings of first and second members, base and of the angle-brace coupler can be by any suitable means. Preferably, such couplings will allow pivoting between the components. For example, the couplings can be by pins 112, which may be secured by a suitable locking mechanism, by threading, or any other suitable fastening mechanism and/or technique known in the art. For example, pins 112 can be clevis pins with a cross-hole for receiving a split pin. Those skilled in the art will appreciate that pins 112 allow pivoting of the components. For example, as can be seen from FIGS. 6 and 7, "L" shaped units 14 can include three machined steel pieces held together with four large pins 112 (e.g. 1 inch in diameter and at least 3 inches in length).

Barrier 12 may be easily deployed around military installations, checkpoints, federal state and municipal assets, along parade routes, around event gatherings for large groups of people, athletic events, and any other location where an easy to install vehicle defense and deterrent is needed to protect lives and/or property. Barrier 12 may also be used to temporarily close roadways, entrance ramps, exit ramps, block off city blocks, and buildings in the event of a terrorist attack, natural disaster, or other emergency. Barrier 12 may also be deployed to protect first responders from inattentive drivers at roadway or roadside accident sites. Barrier 12 may also be used to establish a perimeter and designate certain areas.

Barrier 12 may be deployed by first assembling each "L" shaped unit 14 needed to form an adequate barrier based on the length or perimeter of the area needing protection. To assemble each "L" shaped unit 14, the components are first unloaded from a suitable transport. First member 50 is slid into base 20 and attached thereto by a pin to create a first pivotal connection where pivotal movement is limited by the base. Similarly, second member 70 is slid into base 20 and attached thereto by a pin to create a pivotal connection where pivotal movement is limited by the base.

After connecting the first and second members to the base, first member 50 is linked to second member 70 by angle-brace coupler 90. The loop at the first terminus 92 is inserted into first member 50 and secured with a pin 112. The loop at the second terminus 94 is inserted into second member 70 and secured with a pin 112.

After at least two of the "L" shaped units are assembled, the "L" shaped units are lined up into a row such that each "L" shaped unit has a neighboring "L" shaped unit. Each "L" shaped unit is connected to the neighboring "L" shaped unit by coupling a first horizontal bracing to the first member of the "L" shaped unit and to the first member of the neighboring "L" shaped unit. For example, the first members can be coupled by sliding the thimbles 102 in the cable loops of a first horizontal cable 96 over the post 66 of the first members. Also, each "L" shaped unit is connected to the neighboring "L" shaped unit by coupling a second horizontal bracing to the second member of the "L" shaped unit and to the second member of the neighboring "L" shaped unit. For example, the second members can be coupled by sliding the loops of a second horizontal cable over the post 86 of the second members.

Although certain steps are described herein as occurring sequentially, some steps may occur simultaneously with each other or in a different order. The present disclosure of the disclosed system, methods, techniques and functions are not to be limited to the precise description and illustrations. Other embodiments will be apparent to one skilled in the art. As such, the foregoing description merely enables and describes the general uses of the described system and method. While certain embodiments of the system and method have been described for the purpose of this disclosure, those skilled in the art can make changes without departing from the spirit and scope thereof. Thus, the appended claims define what is claimed.

While apparatuses and methods are described in terms of "comprising," "containing," or "including" various components or steps, the apparatuses and methods also can "consist essentially of" or "consist of" the various components and steps. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a to b") disclosed herein is to be understood to set forth every number and range encompassed within the broader range of values. Additionally, where the term "about" is used in relation to a range, it generally means plus or minus half the last significant figure of the range value, unless context indicates another definition of "about" applies.

Also, the terms in the claims have their plain, ordinary meaning unless otherwise explicitly and clearly defined by the patentee. Moreover, the indefinite articles "a" or "an", as used in the claims, are defined herein to mean one or more than one of the element that it introduces.

What is claimed is:

1. A portable vehicle barrier comprising:

at least two generally "L" shaped units, each of said generally "L" shaped units including:

a base having a side profile comprising a first edge, a second edge and a third edge, wherein said first edge and said second edge meet at an apex, and said third edge extends from said first edge to said second edge, and wherein said third edge meets said second edge so as to form a point;

a first member having a first end and a second end, wherein said first member further has a pointed foot at an angle from said first end of said first member, and wherein said first end of said first member is received in said base, and said first end is detachably and pivotally coupled to said base such that prior to an impact said first member extends horizontally from said base, and upon impact said second end of said first member pivots upwards and said pointed foot pivots downward to dig into a surface;

a second member, wherein said second member has a first end and a second end, and wherein said first end of said second member is received in said base and detachably coupled to said base such that said second member extends vertically from said base, and said base, said first member and said second member form said generally "L" shaped unit, and wherein said point is positioned distal from said detachable coupling of said first member and distal from said detachable coupling of said second member; and an angle-brace coupler coupled to said first member and said second member, wherein said angle-brace coupler is coupled at a first terminus to said first member at a position distal from said first end and said second end of said first member, and is coupled at a second terminus to said second member at a position distal from said first end of said second member, and wherein said angle-brace coupler is flexible so as to resiliently bend towards said base when impacted; and a first flexible cable connecting said first member of each of said generally "L" shaped units, wherein said first flexible cable has a plurality of loops, each said loop having a thimble positioned therein, and wherein said thimble has an orifice for receiving a post mounted on said first member; and a second flexible cable connecting said second member of each of said generally "L" shaped units.

2. The portable vehicle barrier of claim 1, wherein said first member and said second member are perpendicular to each other.

3. The portable vehicle barrier of claim 1, wherein said first member and said second member each have a mid-point midway between said first end and said second end, and wherein said position distal from said first end of said first member is between said mid-point and said second end of said first member, and said position distal from said first end of said second member is between said mid-point and said second end of said second member.

4. The portable vehicle barrier of claim 1, wherein said third edge has an arcuate shape so as to form said point with said second edge.

5. A portable vehicle barrier comprising:

at least two generally "L" shaped units, each of said generally "L" shaped units including:

a base having a side profile comprising a first edge, a second edge and a third edge, wherein said first edge and said second edge meet at an apex, and said third edge extends from said first edge to said second edge, and wherein said third edge has an arcuate shape so as to form a point with said second edge;

a first member having a first end, a second end and a mid-point midway between said first end and said second end, wherein said first member further has a pointed foot at an angle from said first end of said first member, and wherein said first end of said first member is received in said base, and said first end is detachably and pivotally coupled to said base such that prior to an impact said first member extends horizontally from said base, and upon impact said second end of said first member pivots upwards and said pointed foot pivots downward to dig into a surface;

a second member, wherein said second member has a first end, a second end and a mid-point midway between said first end and said second end, and wherein said first end of said second member is received in said base and detachably coupled to said base such that said second member extends vertically from said base and is perpendicular to said first member, and wherein said point is positioned distal from said detachable coupling of said first member and distal from said detachable coupling of said second member; and an angle-brace coupler coupled to said first member and said second member, wherein said angle-brace coupler is coupled at a first terminus to said first member at a position between said mid-point and said second end of said first member, and is coupled at a second terminus to said second member at a position between said mid-point and said second end of said second member, and wherein said angle-brace coupler is flexible so as to resiliently bend towards said base when impacted; and a first flexible cable connecting said first member of each of said generally "L" shaped units, wherein said first flexible cable has a plurality of loops, each said loop having a thimble positioned therein, and wherein said thimble has an orifice for receiving a post mounted on said first member; and a second flexible cable connecting said second member of each of said generally "L" shaped units.

6. A method of deploying a portable vehicle barrier, said method comprising:

assembling a plurality of "L" shaped units wherein each of said generally "L" shaped units includes:

a base having a side profile comprising a first edge, a second edge and a third edge, wherein said first edge and said second edge meet at an apex, and said third edge extends from said first edge to said second edge, and wherein said third edge meets said second edge so as to form a point;

a first member having a first end and a second end, wherein said first member further has a pointed foot at an angle from said first end of said first member;

a second member, wherein said second member has a first end and a second end, and wherein said first end of said second member is received in said base and detachably coupled to said base such that said second member extends vertically from said base, and wherein said point is positioned distal from said detachable coupling of said first member and distal from said detachable coupling of said second member; and an angle-brace coupler, which is flexible; and said assembling includes the steps of:

receiving said first end of said first member in said base;

attaching said first member to a base by a pin to create a first detachable and pivotal connection where pivotal movement is limited by said base, and wherein said first member is coupled to said base such that prior to an impact, said first member extends horizontally from said base, and upon impact said second end of said first member pivots upwards and said pointed foot pivots downward to dig into a surface;

receiving said first end of said second member in said base;

attaching a second member to said base by a pin to create a detachable connection with said base such that said second member extends vertically from said base, and wherein said point is positioned distal from said detachable coupling of said first member and distal from said detachable coupling of said second member;

linking said first member to said second member by an angle-brace coupler, wherein said angle-brace coupler is attached to said first member at a first position on said first member, said first position being distal from said attachment of said first member to said base, and said angle-brace coupler is attached to said second member at a second position on said second position, said second position being distal from said attachment of said second member to said base, and wherein said base, said first member, second member and said angle-brace coupler form said "L" shaped unit, and wherein said angle-brace coupler resiliently bends towards said base when impacted;

lining up said "L" shaped units up into a row such that each generally "L" shaped unit has a neighboring "L" shaped unit;

connecting each "L" shaped unit to said neighboring "L" shaped unit by coupling a first flexible cable to said first member of said "L" shaped unit and to said first member of said neighboring "L" shaped unit, wherein said first flexible cable has a plurality of loops, each said loop having a thimble positioned therein, and wherein said thimble has an orifice for receiving a post mounted on said first member; and connecting each "L" shaped unit to said neighboring "L" shaped unit by coupling a second flexible cable to said second member of said "L" shaped unit and to said second member of said neighboring "L" shaped unit.

7. The method of claim 6, wherein said first flexible cable and said second flexible cable allow bending of said row of "L" shaped units.

* * * * *